US006676371B1

(12) United States Patent
Brown

(10) Patent No.: US 6,676,371 B1
(45) Date of Patent: Jan. 13, 2004

(54) DOUBLE BARREL VEHICLE COOLING FAN SHROUD

(75) Inventor: Daniel J. Brown, Northville, MI (US)

(73) Assignees: Custom Molders, Inc., Durham, NC (US); Labelle-Suomela, Inc., Redford Township, MI (US)

( * ) Notice: Subject to any disclaimer, the term of this patent is extended or adjusted under 35 U.S.C. 154(b) by 0 days.

(21) Appl. No.: 10/226,030

(22) Filed: Aug. 22, 2002

(51) Int. Cl.[7] ..... F04D 29/54

(52) U.S. Cl. ..... 415/173.1; 415/220; 415/222; 415/176; 123/41.49; 165/122; 248/213.3; 248/229.11; 248/229.22

(58) Field of Search ..... 415/173.1, 208.1, 415/211.1, 220, 222, 175–178; 416/189, 192; 123/41.49; 165/51, 121, 122; 248/213.3, 213.4, 229.11, 229.22

(56) References Cited

U.S. PATENT DOCUMENTS 2,217,608 A * 10/1940 Atchison ..... 415/208.1
3,937,192 A * 2/1976 Longhouse ..... 123/41.49
4,767,262 A * 8/1988 Simon ..... 415/119
4,927,328 A * 5/1990 Scoates et al. ..... 415/220
5,342,173 A * 8/1994 Vera ..... 416/192
5,740,766 A * 4/1998 Moser ..... 123/41.49
5,960,748 A 10/1999 Lewis
5,971,062 A 10/1999 Sadr et al.
6,041,744 A * 3/2000 Oota et al. ..... 123/41.49
6,155,335 A 12/2000 Acre et al.
6,189,492 B1 2/2001 Brown
6,315,034 B1 11/2001 Mahe et al.
6,523,507 B2 * 2/2003 Schmitz et al. ..... 123/41.55

FOREIGN PATENT DOCUMENTS

JP 63-94019 A * 4/1988 ..... 415/173.1

* cited by examiner

*Primary Examiner*—Christopher Verdier
(74) *Attorney, Agent, or Firm*—Carlson, Gaskey & Olds

(57) ABSTRACT

A fan shroud includes a barrel portion which surrounds a cooling fan. The barrel portion includes a first cylindrical portion located within a second cylindrical portion about a cooling fan axis of rotation. A multiple of webs are located between the first and second cylindrical portions which strengthen the barrel portion to an extent that a relatively lightweight inexpensive plastic material may be utilized to form the fan shroud without reducing the strength thereof. The webs also provide a multiple of mounting points which may receive a bracket to retain the numerous cables, conduits, hoses, sensors and the like which must be arranged within an engine compartment.

17 Claims, 3 Drawing Sheets

DOUBLE BARREL VEHICLE COOLING FAN SHROUD

BACKGROUND OF THE INVENTION

The present invention relates to a cooling fan shroud for a vehicle, and more particularly to a cooling fan shroud having a double barrel fan protection portion.

Vehicles with liquid cooled engines generally mount the engine cooling heat exchanger (radiator) at the front of the engine compartment, just behind the bumper and grille, so as to take advantage of the ram air effect at higher vehicle speeds. At lower vehicle speeds, an engine cooling fan draws air through the radiator. The fan is generally mounted to a support shroud that both physically secures the fan to the radiator, and which also surrounds the fan to confine and direct the air efficiently through the radiator.

The fan shroud must withstand high downstream radiator air temperatures while providing a rigid support and protective structure for the rotating fan. Conventional fan shrouds are typically formed of a relatively expensive heavy plastic resin material or a relatively thinner metal. Although effective, either material results in a fan shroud that is relatively heavy and expensive to manufacture.

Accordingly, it is desirable to provide a lightweight, inexpensive fan shroud which rigidly mounts and protects the rotating engine fan.

SUMMARY OF THE INVENTION

The fan shroud according to the present invention provides a barrel portion which surrounds a cooling fan and a rectilinear shroud portion which at least partially surrounds a radiator. The barrel portion includes a first cylindrical portion located within a second cylindrical portion coaxial about a fan axis of rotation. A multiple of webs are located between the first and second cylindrical portions. The webs and the first and second cylindrical portions strengthen the barrel portion to an extent that a relatively lightweight inexpensive plastic material such as talc filled polypropylene may be used to form the fan shroud without reducing the strength thereof.

The webs also provide a multiple of mounting points which receive a bracket. As the webs are located about the entire circumference of the barrel potion, the bracket may be mounted in a multiple of positions. Additional security and organization is thereby provided for the numerous cables, conduits, hoses, sensors and the like which must be arranged within an engine compartment.

The present invention therefore provides a lightweight, inexpensive fan shroud which rigidly mounts and protects the rotating engine fan.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
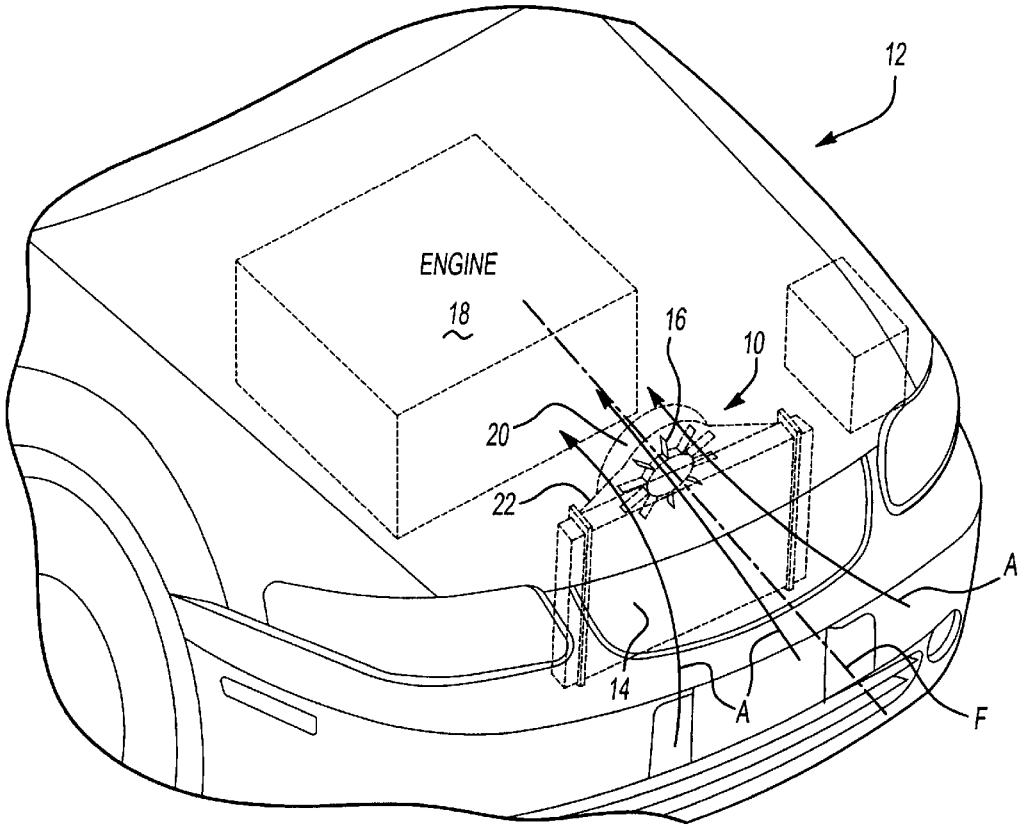
FIG. 1 is a general perspective view a vehicle fan shroud located within an exemplary vehicle embodiment.

FIG. 1 illustrates a general perspective view of a fan shroud 10 mounted within a vehicle 12. The fan shroud 10 is positioned adjacent a radiator 14 which is typically mounted forward of, or partially within the fan shroud 10. A cooling fan 16 is mounted between a vehicle engine (illustrated schematically at 18) and the radiator 14. The fan shroud 10 is mounted adjacent a rear face of the radiator 14 in a position to concentrically surround the cooling fan 16. Cooling fan 16 rotates about axis F to draw ambient air through the radiator 14 in a direction schematically illustrated by arrows A to flow over engine 18.

Typically, the cooling fan 16 is of a smaller diameter than the radiator 14 such that the discharge side of the fan shroud 10 which surrounds the cooling fan 16 includes a substantially cylindrical barrel portion 20. The barrel portion 20 which surrounds the cooling fan 16 is integrated with a substantially rectilinear shroud portion 22 which surround the radiator 14. It should be understood that various shapes which surround or partially surround the radiator 14 will benefit from the present invention.

Figure 3:
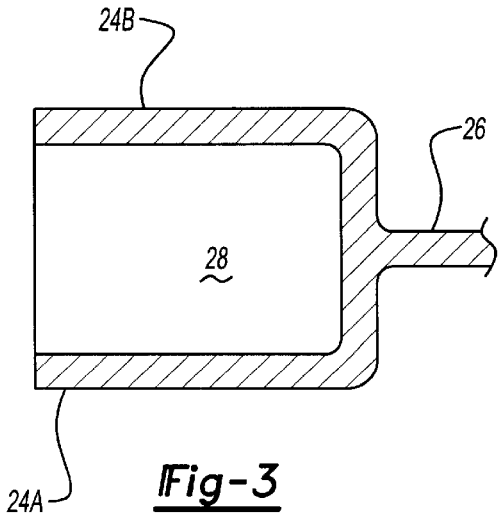
FIG. 3 is a sectional view of the barrel portion of the fan shroud taken along line 3—3 of FIG. 2.
Figure 2:
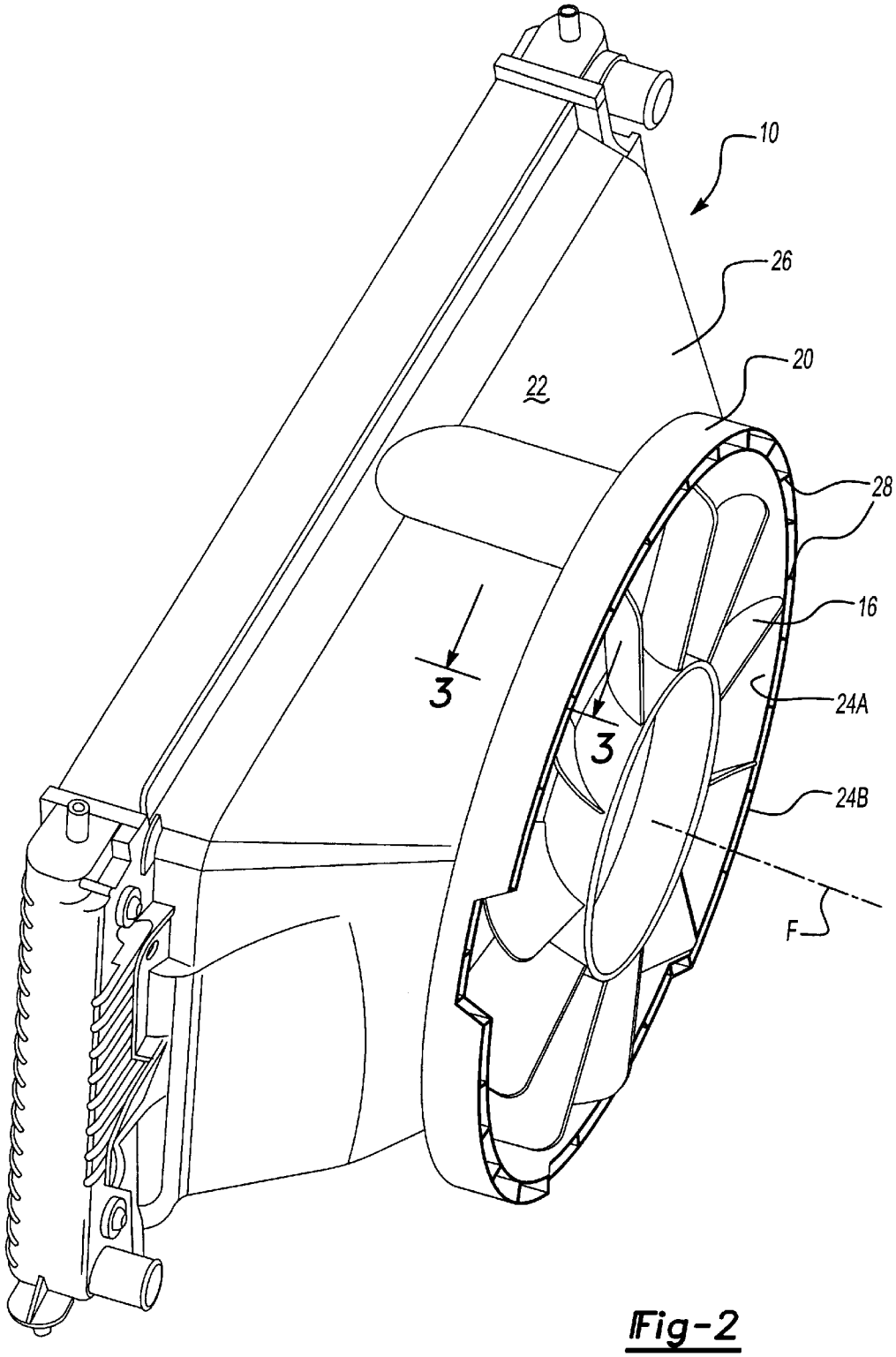
FIG. 2 is an expanded perspective view of the fan shroud.

Referring to FIG. 2, the cooling fan 16 is rotatably mounted about the axis of rotation F and centrally positioned within the barrel portion 20 of the fan shroud 10. The barrel portion 20 is defined about axis F. The barrel portion 20 includes a first cylindrical portion 24A located within a second cylindrical portion 24B. That is, first and second cylindrical portions 24A, 24B are coaxial about axis F. Preferably, the first and second cylindrical portions 24A, 24B merge into a single surface 26 between the barrel portion 20 and the rectilinear shroud portion 22 (FIG. 3).

A multiple of webs 28 are located between the first and second cylindrical portions 24A, 24B. The webs 28 extend radially between the first and second cylindrical portions 24A, 24B about axis F to strengthen the barrel portion 20 to an extent that a relatively lightweight inexpensive plastic material such as talc filled polypropylene may be used to form the fan shroud 10 without reducing the strength thereof.

Figure 4:
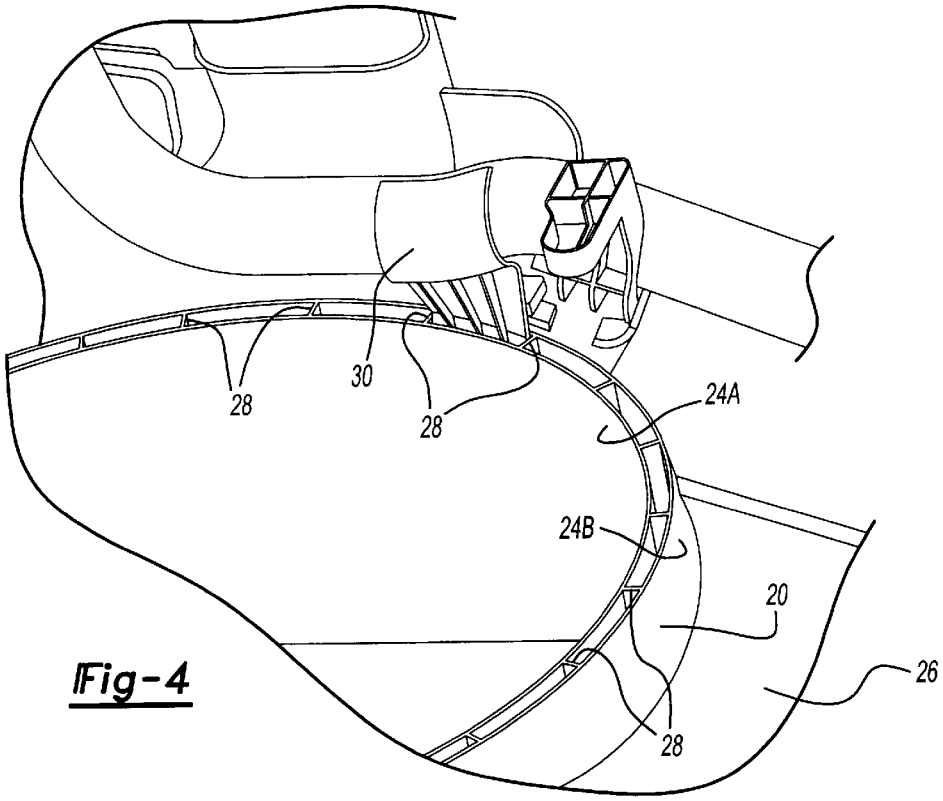
FIG. 4 is an expanded view of a mounting bracket affixed to the barrel portion of the fan shroud according to the present invention.
Figure 5:
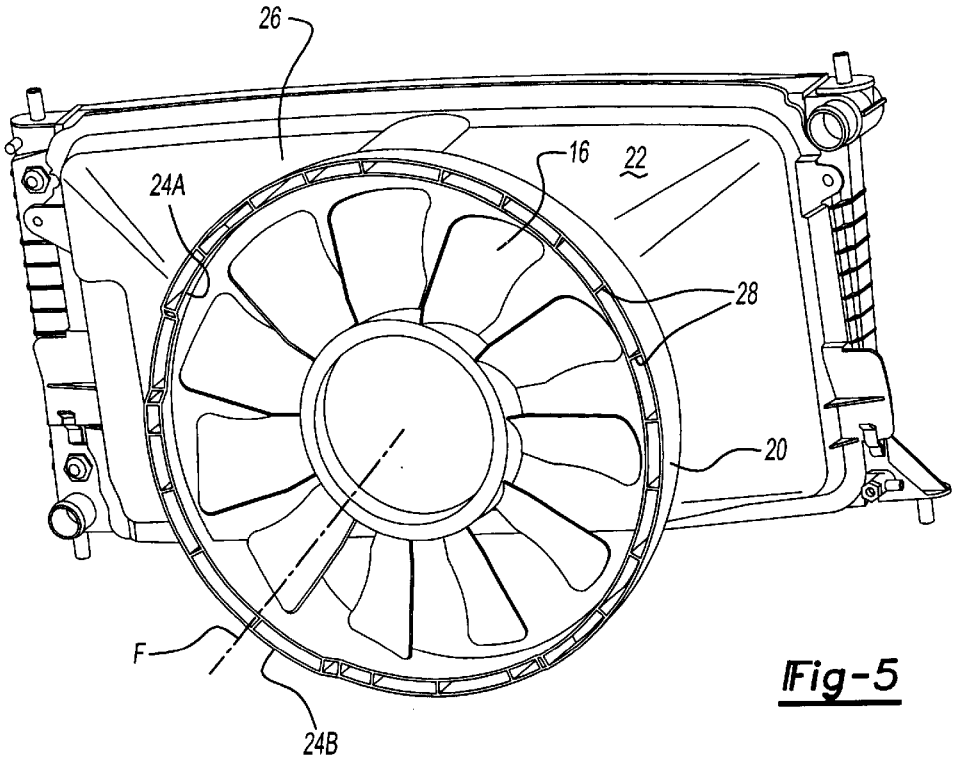
FIG. 5 is an expanded perspective view of the discharge face of the fan shroud.

Referring to FIG. 4, the webs 28 provide a multiple of mounting points. A bracket 30 that engages a hose or the like readily mounts between two or more webs 28. Preferably, a friction fit retains the bracket 30 between the webs 28, however, engagement members such as bayonet, snap, spike or the like may alternatively or additionally be provided. Moreover, as the webs 28 are located about the entire circumference of the barrel potion 20 (FIG. 5), bracket 30 may be mounted in a multiple of positions. Additional security and organization is thereby provided for the numerous cables, conduits, hoses, sensors and the like which must be arranged within an engine compartment.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A vehicle fan shroud comprising:

a rectilinear shroud portion; and a barrel portion molded to said rectilinear shroud portion, said barrel portion comprising a first barrel portion generally parallel to a second barrel portion, said first barrel portion and said second barrel portion defined about and generally parallel to a common axis about which a fan rotates, the fan contained within said first barrel portion and said second barrel portion.

2. The vehicle fan shroud as recited in claim 1, wherein said first barrel portion and said second barrel portion merge intermediate said barrel portion and said rectilinear shroud portion.

3. The vehicle fan shroud as recited in claim 1, wherein said fan shroud is manufactured of a talc filled polypropylene.

4. The vehicle fan shroud as recited in claim 1, wherein said rectilinear shroud portion at least partially surrounds a vehicle radiator.

5. The vehicle fan shroud as recited in claim 1, wherein said barrel portion at least partially surrounds a vehicle cooling fan.

6. The vehicle fan shroud as recited in claim 1, wherein said first barrel portion and said second barrel portion are molded to merge into a single surface between said barrel portion and said rectilinear shroud portion.

7. The vehicle fan shroud as recited in claim 1, wherein said first barrel portion said second barrel portion provide an open end.

8. A vehicle fan shroud comprising:

a rectilinear shroud portion;

a barrel portion molded to said rectilinear shroud portion, said barrel portion comprising a first barrel portion generally parallel to a second barrel portion said first barrel portion and said second barrel portion defined about and generally parallel to a common axis about which a fan rotates the fan contained within said first barrel portion and said second barrel portion; and a plurality of webs mounted between said first barrel portion and said second barrel portion.

9. The vehicle fan shroud as recited in claim 8, wherein said webs extend radially about said common axis.

10. The vehicle fan shroud as recited in claim 8, further comprising a bracket engageable with at least two of said webs.

11. The vehicle fan shroud as recited in claim 8, wherein said first barrel portion and said second barrel portion merge intermediate said barrel portion and said rectilinear shroud portion.

12. The vehicle fan shroud as recited in claim 8, wherein said fan shroud is manufactured of a talc filled polypropylene.

13. The vehicle fan shroud as recited in claim 8, wherein said first barrel portion and said second barrel portion are molded to merge into a single surface between said barrel portion and said rectilinear shroud portion.

14. The vehicle fan shroud as recited in claim 8, wherein said first barrel portion and said second barrel portion provide an open end.

15. A vehicle fan shroud comprising:

a rectilinear shroud portion;

a barrel portion extending from said rectilinear shroud portion, said barrel portion comprising a first barrel portion and a second barrel portion defined about a common axis;

a plurality of webs mounted between said first barrel portion and said second barrel portion; and a bracket engageable with at least two of said webs.

16. A vehicle fan shroud comprising:

a rectilinear shroud portion; and a barrel portion unitarily molded to said rectilinear shroud portion, said barrel portion and said rectilinear shroud portion manufactured from a talc filled polypropylene, said barrel portion comprising a first barrel portion generally parallel to a second barrel portion, said first barrel portion and said second barrel portion defined about and generally parallel to a common axis about which a fan rotates.

17. The vehicle fan shroud as recited in claim 16, wherein said first barrel portion and said second barrel portion are molded to merge into a single surface between said barrel portion and said rectilinear shroud portion.

* * * * *